US009039470B1

(12) United States Patent
Berge

(10) Patent No.: US 9,039,470 B1
(45) Date of Patent: May 26, 2015

(54) SHOE WITH INTEGRATED FIN APPARATUS

(71) Applicant: David Berge, Atkins, AR (US)

(72) Inventor: David Berge, Atkins, AR (US)

( * ) Notice: Subject to any disclaimer, the term of this patent is extended or adjusted under 35 U.S.C. 154(b) by 0 days.

(21) Appl. No.: 14/081,683

(22) Filed: Nov. 15, 2013

(51) Int. Cl.
*A63B 31/08* (2006.01)
*A63B 31/11* (2006.01)

(52) U.S. Cl.
CPC ..... *A63B 31/11* (2013.01)

(58) Field of Classification Search
CPC ..... A63B 31/08; A63B 31/11
USPC ..... 441/60, 61–64
See application file for complete search history.

(56) References Cited

U.S. PATENT DOCUMENTS 4,250,584 A * 2/1981 Korn ..... 441/61
4,907,519 A * 3/1990 Gil ..... 441/61
4,952,183 A * 8/1990 Gil ..... 441/64
5,924,902 A 7/1999 Burns et al.
6,086,440 A * 7/2000 Fechtner ..... 441/64
6,241,567 B1 * 6/2001 Evans ..... 441/64
6,866,615 B2 * 3/2005 Ryland ..... 482/55
6,871,420 B2 3/2005 Shikhasvili
8,333,020 B1 12/2012 Sanchez

* cited by examiner

*Primary Examiner* — Daniel V Venne
(74) *Attorney, Agent, or Firm* — Benjamin F. Williams; Williams Intellectual Property

(57) ABSTRACT

A shoe with integrated fin apparatus including a pair of fin members disposed on either side of a shoe proximal the outsole of said shoe, each of said fin members including a maximum width disposed proximal the toe box of the shoe and a minimum width disposed proximal the heel of said shoe, wherein each of said pair of fin members is moveable between a furled position, securable to a shoe fastener medially disposed atop the toe box, and an unfurled position, disposed splayed laterally along each side of the shoe, whereby said shoe with integrated fin apparatus is wearable for unimpeded locomotion upon dry land and is also usable to effect increased water displacement when swimming.

6 Claims, 4 Drawing Sheets

SHOE WITH INTEGRATED FIN APPARATUS

BACKGROUND OF THE INVENTION

Various types of fin apparatuses are known in the prior art to effect increased mobility in water. However, what is needed is a shoe with integrated fin apparatus that includes a pair of fin members disposed on either side of a shoe proximal the outsole of said shoe, each of said fin members including a maximum width disposed proximal the toe box of the shoe and a minimum width disposed proximal the heel of said shoe, wherein each of said pair of fin members is moveable between a furled position, securable to a shoe fastener medially disposed atop the toe box, and an unfurled position, disposed splayed laterally along each side of the shoe, whereby said shoe with integrated fin apparatus is wearable for unimpeded locomotion upon dry land while usable to effect increased water displacement when swimming, as desired.

FIELD OF THE INVENTION

The present invention relates to a shoe with integrated fin apparatus, and more particularly, to a shoe with integrated fin apparatus that includes a pair of fin members disposed on either side of a shoe proximal the outsole of said shoe, each of said fin members including a maximum width disposed proximal the toe box of the shoe and a minimum width disposed proximal the heel of said shoe, wherein each of said pair of fin members is moveable between a furled position, securable to a shoe fastener medially disposed atop the toe box, and an unfurled position, disposed splayed laterally along each side of the shoe, whereby said shoe with integrated fin apparatus is wearable for unimpeded locomotion upon dry land and also usable to effect increased water displacement when swimming, as desired.

SUMMARY OF THE INVENTION

The general purpose of the shoe with integrated fin apparatus, described subsequently in greater detail, is to provide a shoe with integrated fin apparatus which has many novel features that result in a shoe with integrated fin apparatus which is not anticipated, rendered obvious, suggested, or even implied by prior art, either alone or in combination thereof.

Many swimmers know the benefit of fins when swimming—increased mobility, speed, and agility is afforded the swimmer while wearing fins in water. However, locomotion upon dry land is often made awkward, and significantly impeded, when wearing fins. What is needed is a shoe with integrated fin apparatus having a pair of fin members disposed laterally thereon, each of said pair of fin members securable in a furled position tightly and snugly around the shoe for unimpeded locomotion on dry land, and an unfurled position for use in water, whereby each of said pair of fin members are deployable into said unfurled position for increased water displacement when swimming.

The present shoe with integrated fin apparatus, therefore, has been devised to enable increased mobility, agility, and propulsion of a wearer swimming in water, while enabling safe and unimpeded locomotion while perambulating on dry ground. The present shoe with integrated fin apparatus includes a pair of fin members moveable between a furled position, with each of said pair of fin members releasably secured in a furled position snugly around the shoe, and an unfurled position, with each of said pair of fin members disposed laterally splayed from either side of the shoe.

A user may, therefore, secure each of the pair of fin members in the furled position for unimpeded locomotion upon dry land and then, when readying for immersion in water, unfurl each of the pair of fin members for use while swimming in water.

The present shoe with integrated fin apparatus is contemplated as a pair of shoes having such common features, enantiomorphically disposed for use upon each foot, as set forth herein and applied to but one shoe. However, the features, structure, mode of operation, shape and purpose of the shoe with integrated fin apparatus, as set forth herein, is intended for each of a pair of shoes and set forth singly for ease of communication of the novel features and useful improvements comprising the instant invention. The invention should, not therefore, be considered as a single shoe only.

The shoe with integrated fin apparatus, therefore, includes a pair of fin members laterally disposed along each side of the shoe proximal the out sole of the shoe. In the preferred embodiment herein disclosed, the pair of fin members is disposed along an upper edge defined between the outsole and the shoe upper.

Each of the pair of fins includes a maximum width disposed proximal the toe box of the shoe, and a minimum width, disposed proximal the heel of the shoe. Each of the pair of fin members may include a concave, arced edge disposed along said maximum width, terminating at a corner. Each fin member may further include a long edge disposed along an outer boundary of said fin member, in a plane parallel with the shoe, before sloping towards the shoe proximal the shoe quarter, and abutting the shoe at the minimum width proximal the heel.

Each of the pair of fin members is sized appropriate to snugly overlie the vamp and toe box of the shoe when moved to the furled position, for compact storage of said fin members about the shoe during locomotion upon dry land. A fastener is disposed cornerwise upon each fin member at the maximum width, said fastener disposed to interconnect with a shoe fastener disposed medially atop the toe box of the shoe.

Thus each of the pair of fin members is moveable to the furled position, overlying and abutting the shoe upper, for releasable securement to the shoe fastener disposed atop the shoe toe box. It is contemplated that each fastener disposed upon each of the pair of fin members will interconnect, whereby one of the pair of fin members is securable to the shoe fastener directly, and secured in the furled position thereby, and the other of the pair of fin members thence is securable to the fastener of the previously secured fin member, whereby each of the pair of fin members is securable in the furled position.

Each of the pair of fin members is contemplated to be wrought of a polymeric or rubberlike material, and therefore flexible enough along an inside edge connected to the shoe to furl into the furled position, but inflexible enough to afford water displacement when in the unfurled position and a wearer is swimming in water.

Thus has been broadly outlined the more important features of the present shoe with integrated fin apparatus so that the detailed description thereof that follows may be better understood and in order that the present contribution to the art may be better appreciated.

Objects of the present shoe with integrated fin apparatus, along with various novel features that characterize the invention are particularly pointed out in the claims forming a part of this disclosure. For better understanding of the shoe with integrated fin apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
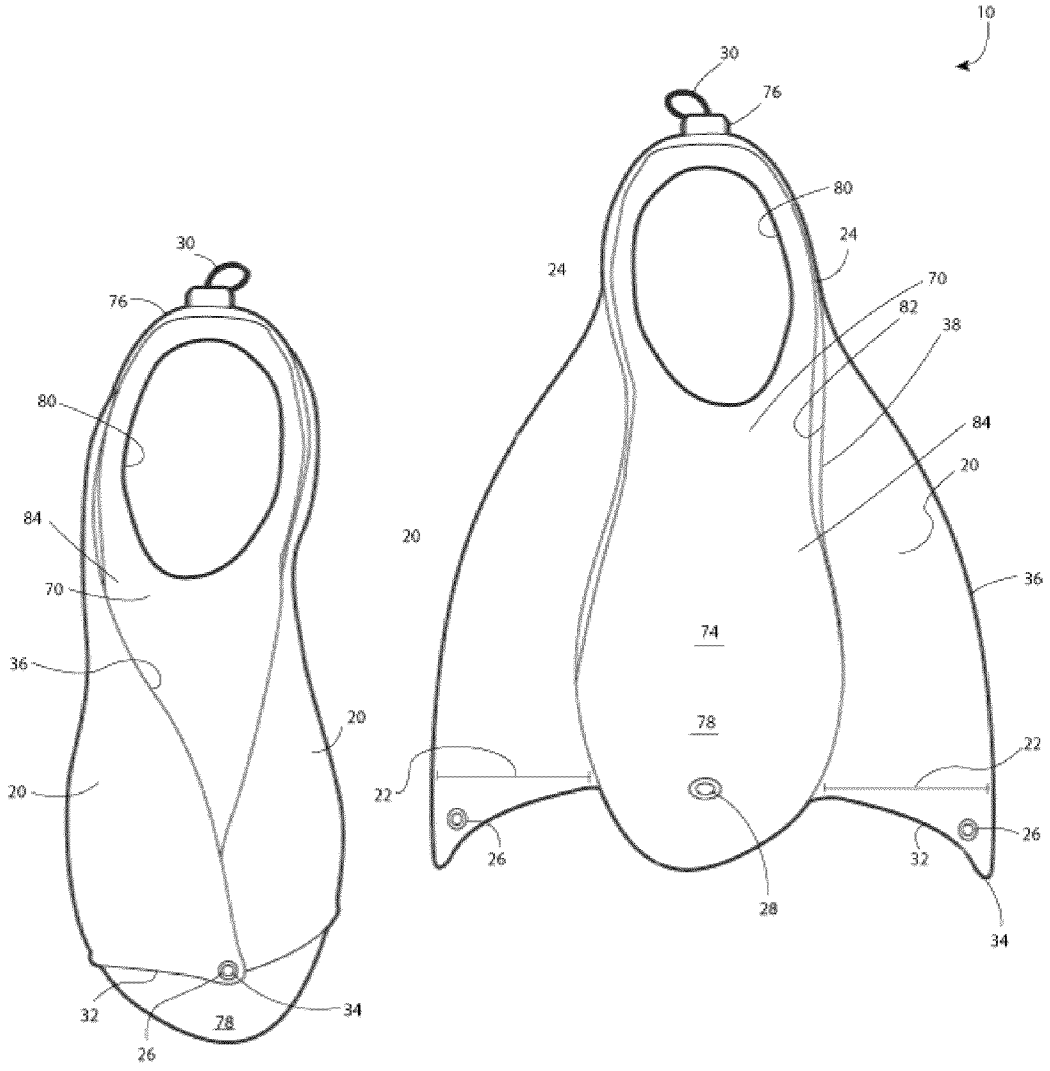
FIG. 1 is an isometric view of a pair of shoes with integrated fin apparatus, one of said pair of shoes disposed with a pair of fin members disposed in a furled position and the other of said pair of shoes disposed with a pair of fin members disposed in an unfurled position.
Figure 2:
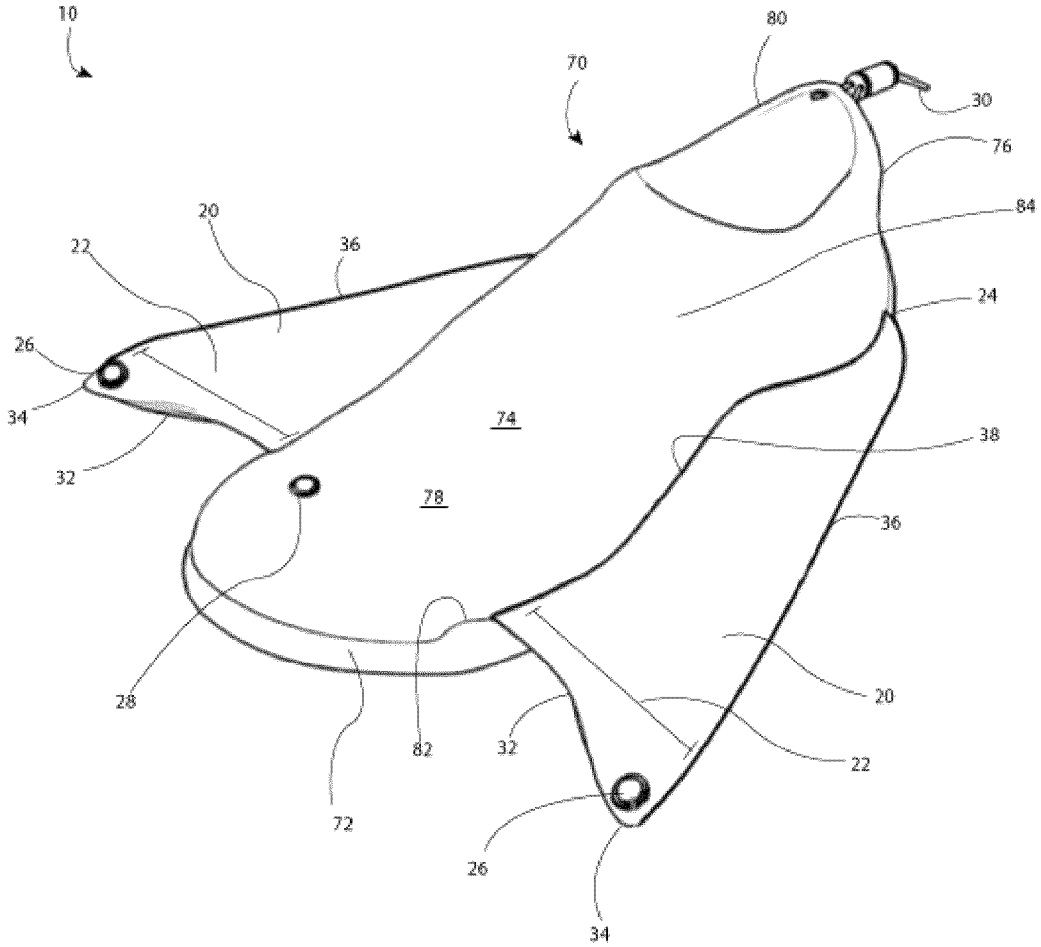
FIG. 2 is an isometric view of a shoe having a pair of fin members disposed in an unfurled position.
Figure 3:
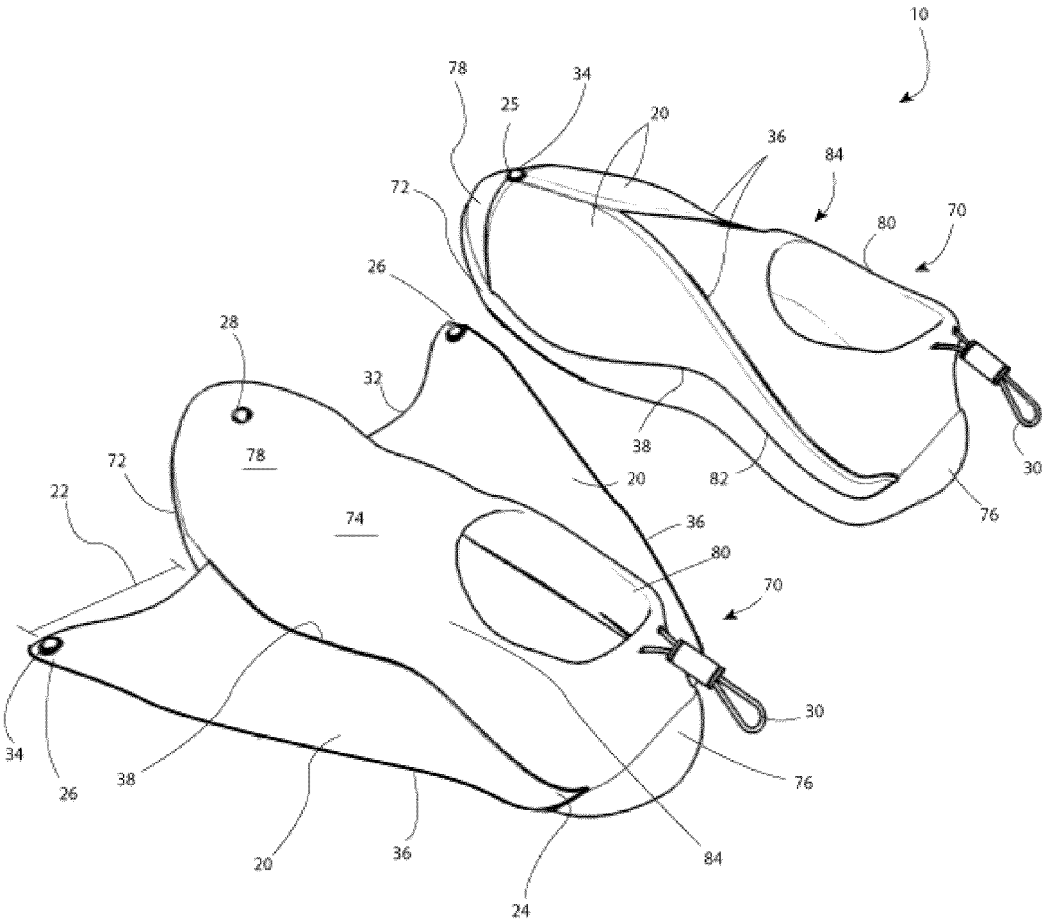
FIG. 3 is an isometric view of the pair of shoes with integrated fin apparatus, one of said pair of shoes disposed with a pair of fin members disposed in the furled position and the other of said pair of shoes disposed with the pair of fin members disposed in an unfurled position.
Figure 4:
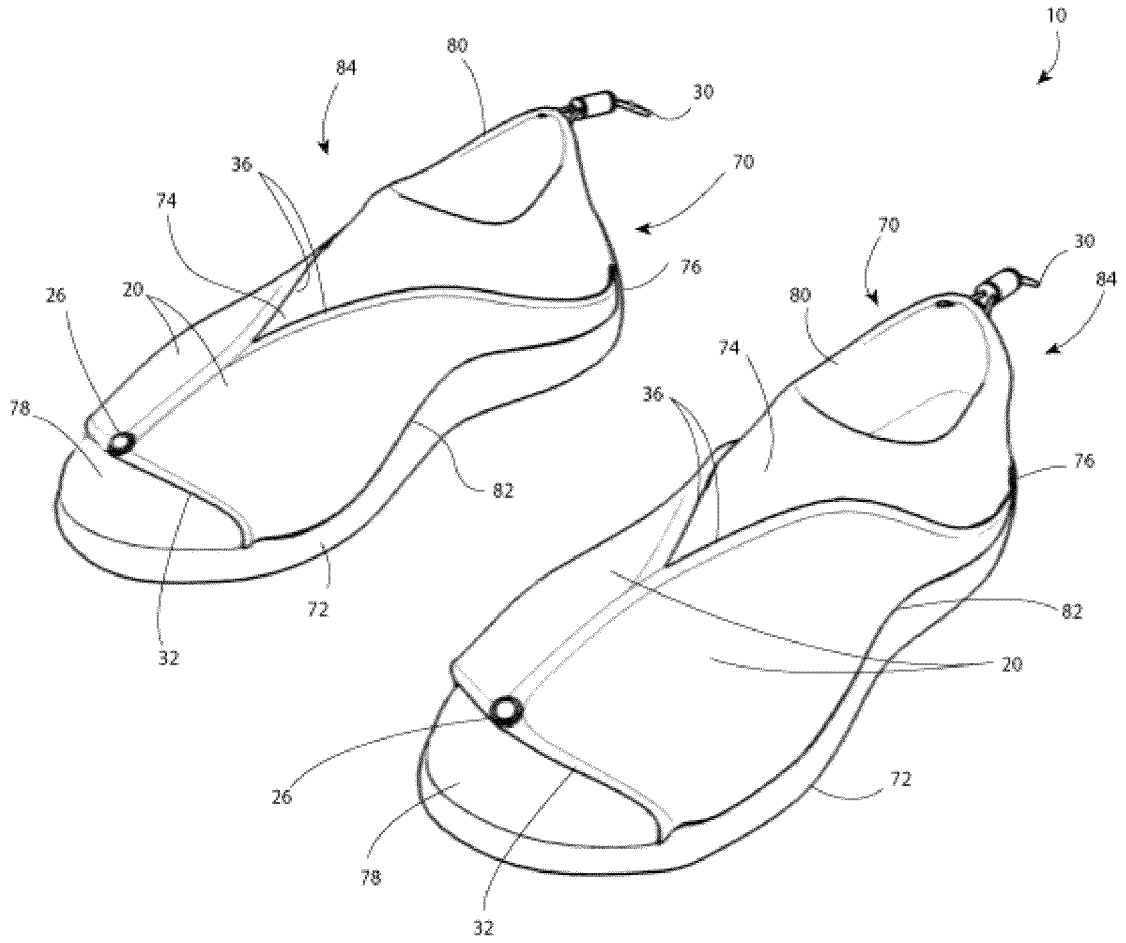
FIG. 4 is an isometric view of the pair of shoes, each of said pair of shoes disposed with the pair of fins secured in the furled position.

With reference now to the drawings, and in particular FIGS. 1 through 4 thereof, example of the instant shoe with integrated fin apparatus employing the principles and concepts of the present shoe with integrated fin apparatus and generally designated by the reference number 10 will be described.

Referring to FIGS. 1 through 4 a preferred embodiment of the present shoe with integrated fin apparatus 10 is illustrated.

The present shoe with integrated fin apparatus 10 has been devised to provide a convenient means of effecting increased water displacement when swimming, and therefore increased speed and agility of a wearer when in the water, while enabling ease of locomotion while on dry land. The present shoe with integrated fin apparatus 10 includes a pair of fin members 20 disposed laterally upon the shoe 70, each of which pair of fin members 20 is moveable between a furled position, disposed snugly around the shoe 70 to overlie a vamp 74 and toe box 78 of the shoe 70, and a furled position laterally splayed therefrom.

The present invention 10 is directed to a pair of shoes with integrated fin apparatus 10 for use on each foot of a wearer. However, for ease of explanation—the structural features of each of said pair of shoes 10 identically rendered and enantiomorphic with respect to each other—a single one of the pair of shoes with integrated fin apparatus 10 will herein be described. The present disclosure, therefore, is intended for both of a pair of shoes for use, as illustrated in the accompanying drawings.

The present shoe with integrated fin apparatus 10, therefore includes a pair of fin members 20 laterally disposed upon a shoe 70 proximal the out sole 72 of the shoe 70. Each of the pair of fin members 20 is generally triangular, and made of a polymeric or rubberlike material.

Each of the pair of fin members 20 has a maximum width 22 proximal a vamp 74 of the shoe 70 and a minimum width 24 proximal a heel 76 of the shoe. Each of said pair of fin members 20 is moveable between a furled position, for walking upon dry ground, and an unfurled position, for use when swimming.

A fastener 26 is disposed upon each of the pair of fin members 20 cornerwise at the maximum width 22. Each of said fasteners 26 is connectable thereat to a shoe fastener 28 disposed atop a toe box 78 of the shoe 70. The pair of fin members 20 is thus storable in the furled position and thereat disposed snugly abutting the shoe 70 overlying the vamp 74 and toe box 78 of said shoe 70.

A drawstring 30 is disposed around a top line 80 of the shoe 70, said drawstring 30 adjustable to secure the top line 80 around an ankle of a wearer, as desired, when the shoe 70 is worn and to maintain fit of the shoe 70 during swimming.

In the preferred embodiment set forth herein, each of the pair of fin members 20 is disposed on either side of the shoe 70 along an upper edge 82 disposed between the shoe 70 outsole 72 and an upper 84 of the shoe 70. Each of the pair of fin members 20 includes a concave, arced edge 32 disposed along the maximum width 22, said arced edge 32 terminating at a corner 34. Each fin member further 20 includes a long edge 36 disposed along an outer boundary of said fin member 20, in a plane parallel with the shoe 70, before sloping towards the shoe 70 and abutting the shoe 70 at the minimum width 24 proximal the heel 76.

Each of the pair of fin members 20 is contemplated to be wrought of a polymeric or rubberlike material, and therefore flexible enough along an inside edge 38, connected to the shoe 70, to furl into the furled position, but inflexible enough to afford water displacement when in the unfurled position and a wearer is swimming in water.

Each of the pair of fin members 20 is therefore storable snugly around the shoe 70 vamp 74 and toe box 78 when connected atop the toe box 78 in the furled position for walking on dry land, and each of the pair of fin members 20 is extendible laterally from the shoe 70 when moved to the unfurled position for use when swimming.

What is claimed is:

1. A shoe with integrated fin apparatus comprising a pair of fin members disposed laterally upon said shoe, each of said pair of fin members disposed upon the shoe proximal an outsole of the shoe upon either side of a vamp of the shoe, each of said pair of fin members connected proximal a heel of the shoe, wherein each of the pair of fin members is connectable atop a toe box of the shoe when folded to a furled position and positional splayed laterally from the shoe when disconnected therefrom and moved to an unfurled position, whereby each of said pair of fin members may be furled when walking upon dry ground and each of the pair of fin members may be unfurled to displace water when swimming.

2. The shoe with integrated fin apparatus of claim 1 wherein the shoe further comprises a drawstring disposed around a top line of the shoe whereby the shoe is adjustably securable around a wearer's ankle.

3. The shoe with integrated fin apparatus of claim 2 wherein each of the pair of fin members is connectable atop the toe box and storable in the furled position by means of a fastener.

4. The shoe with integrated fin apparatus of claim 3 wherein each of the pair of fin members is generally triangular in shape and converges from a maximum width proximal the toe box of the shoe to a minimum width proximal the heel of the shoe.

5. A shoe with integrated fin apparatus for use walking on dry land and to assist swimming in aqueous environments, said shoe comprising:

a pair of fin members laterally disposed upon said shoe proximal an out sole of the shoe, each of said pair of fin members having a maximum width proximal a vamp of the shoe and a minimum width proximal a heel of the shoe, each of said pair of fin members moveable between a furled position, for walking upon dry ground, and an unfurled position, for use when swimming;

a fastener disposed upon each of the pair of fin members cornerwise at the maximum width, each of said fasteners connectable to a shoe fastener disposed atop a toe box of the shoe;

a drawstring disposed around a top line of the shoe, said drawstring adjustable to secure the top line around an ankle of a wearer;

wherein each of the pair of fin members is storable snugly around the shoe vamp and toe box when connected atop the toe box in the furled position for walking on dry land, and each of the pair of fin members is extendible laterally from the shoe when moved to the unfurled position for use when swimming.

6. A shoe with integrated fin apparatus for use walking on dry land and to assist swimming in aqueous environments, said shoe comprising:

a pair of fin members laterally disposed upon said shoe along an upper edge disposed between an outsole and an upper of said shoe, each of said pair of fin members comprising:

a concave, arced edge disposed along a maximum width of the fin proximal a toe box of the shoe;

a long edge disposed bounding said fin member in parallel with the upper edge of the shoe, said long edge curving into a minimum width of said fin member proximal a heel of the shoe;

a corner disposed between the arced edge and the long edge;

an inside edge disposed connected to the upper edge of the shoe, said inside edge flexible enough to enable movement of said fin member between a furled position and an unfurled position;

a fastener disposed proximal the corner, said fastener connectable to a shoe fastener medially disposed atop the toe box of the shoe;

a drawstring disposed around a top line of the shoe, said drawstring adjustable to secure the top line around an ankle of a wearer;

wherein the fastener of each of the pair of fin members is connectable together and securable to the shoe fastener, whereby the pair of fin members is storable snugly around the shoe vamp and toe box when connected atop the toe box in the furled position for unimpeded locomotion on dry land, and each of the pair of fin members is extendible laterally from the shoe when moved to the unfurled position for use when swimming.

* * * * *